US006353390B1

(12) United States Patent
Beri et al.

(10) Patent No.: US 6,353,390 B1
(45) Date of Patent: Mar. 5, 2002

(54) METHOD AND SYSTEM OF CONFIGURING A BOUNDARY AND TRACKING AN OBJECT THEREBY

(76) Inventors: Jeffrey Beri, 7 Pond Edge Rd., Westport, CT (US) 06880; Raymond J. Werner, 3235 NW. 132nd Pl., Portland, OR (US) 97229

( * ) Notice: Subject to any disclaimer, the term of this patent is extended or adjusted under 35 U.S.C. 154(b) by 0 days.

(21) Appl. No.: 09/477,831

(22) Filed: Dec. 31, 1999

(51) Int. Cl.[7] ..... G08B 13/14

(52) U.S. Cl. ..... 340/572.1; 340/572.4; 340/573.1; 340/825.49

(58) Field of Search ..... 340/568.1, 572.1, 340/572.4, 573.1, 825.49, 10.1, 10.51, 505; 379/37, 38; 455/405–408; 700/115, 213, 225, 226

(56) References Cited

U.S. PATENT DOCUMENTS 6,034,622 A * 3/2000 Levine ..... 340/10.1
6,043,748 A * 3/2000 Touchton et al. ..... 340/573.3
6,078,260 A * 6/2000 Desch ..... 340/573.1
6,137,414 A * 10/2000 Federman ..... 340/572.1 X

* cited by examiner

*Primary Examiner*—Thomas Mullen
(74) *Attorney, Agent, or Firm*—Marshall E. Rosenberg

(57) ABSTRACT

A location monitoring system for tracking an object relative to a virtual boundary via telecommunication infrastructure for use in an electronic-commerce environment. In one embodiment the system includes a wireless communications network and the telecommunications infrastructure to dynamically configure the virtual boundary, by controlled, subscription-based access to the location monitoring system.

38 Claims, 2 Drawing Sheets

METHOD AND SYSTEM OF CONFIGURING A BOUNDARY AND TRACKING AN OBJECT THEREBY

BACKGROUND OF THE INVENTION

1. Field of the Invention

The method and apparatus of the present invention relate to the field of configuring boundaries and monitoring objects thereby.

2. Description of the Related Art

There are numerous locating, tracking and monitoring protocols in use today, for use in conjunction with physical boundaries and fences, as necessary to locate, track and monitor the location and proximity of an object relative to the physical boundary. Such objects may be animate or inanimate, such as pets, livestock, valuables, inventory, equipment, personnel, and the like. Although locating an object to be tracked may be readily achieved using transmitter/receiver-based technology, tracking and monitoring systems of the related prior art have proven to be limited and limiting in their application. More particularly, related prior art systems generally require fixed boundaries or points of reference against which an independently movable object to be tracked is monitored. Moreover, the larger the circumscribed area or the more buildings within the circumscribed area, or an area ranging over challenging topographical and geographical terrain typically becomes increasingly difficult and expensive to monitor, and indeed, contain the object to be tracked. Even after establishing an initial physical boundary or fence, it may later be desired to alter the geographical region in which the tracked object is permitted to roam.

Alternatively, it may be desirable to provide durational limitations to accessing certain geographical areas. In those instances, prior art transportable physical boundaries are poorly suited to these changing needs and requirements. Additionally, prior art physical boundaries may undesirably hinder the establishment of acceptable points of ingress and egress over the boundary, and even in those instances, prior art technology fails to provide means for monitoring those points of ingress/egress or for doing so on a real-time basis. In any case, the related prior art does not provide for modification of desired boundaries from a remote location, or for tracking or monitoring of the tracked object from the remote location.

Several solutions to the problem of tracking and monitoring objects to be tracked have been tried or implemented with varying levels of success. For example, simple physical boundaries such as fencing provides a physical impediment to ingress and egress from a desired bounded area. However, simple fencing is typically labor intensive in its erection, maintenance and monitoring, and is poorly suited to rapid relocation on a time- and cost-effective basis. Concealed, electronic-based fencing typically used to control or limit otherwise uncontrollable excursions by some household pets beyond the fenced area also requires a physical installation, which is also labor intensive and likewise poorly suited to modification on an expedited basis. Such systems utilize radio frequency identification in which a radio frequency transmitter is attached or carried by the object to be identified and tracked by a remotely located receiver. However, this method is only effective if one is willing to go to the effort of placing the equipment within the "read range" of the receiver. As this typically does not occur during the use of this type of equipment because most transmitter/receiver pairs operate at low power over a relatively short range, the object to be tracked is essentially "lost" if located a substantial distance from the last point that the transmitter was read, such that the transmitter must be continuously transmitting within the read range of the receiver, and sporadic reading of the receiver outside of the read range will fail to provide a consistent and complete stream of information regarding tracking and trajectory history of the object to be tracked, with a resulting absence of dependable and reliable on-demand tracking and monitoring feedback information.

For tracking protocols which do not use physical boundaries, individual objects to be tracked do not carry radio frequency transmitters, and the objects must be physically tracked by an attendant, the location of the tracked object confirmed only at the particular moment the attendant scans in object-specific information as by bar-coding and the like. Thus, prior art tracking systems fail to provide readily and dynamically reconfigurable boundaries, important on-demand tracking, and self-reporting monitoring feedback information, as well as the capability to do all of the above from a location remote from the area to be bounded.

Accordingly, there is a need for a system and method of readily establishing and dynamically configuring and reconfiguring boundaries against which the excursions of an object is tracked and monitored, and for monitoring excursions of an object to be tracked with immediate response, all from a location remote from the region to be bounded.

SUMMARY OF THE INVENTION

The present invention is a method and apparatus for identifying, locating, and monitoring an object to be tracked within a user-defined area. The invention utilizes a communications network to establish a dynamically reconfigurable "virtual" boundary against which proximity and excursions of the tracked object is monitored, and notification is provided to the user for user-specified contingent action if the tracked object crosses the virtual boundary or a defined opened or closed bounded area, hereinafter referred to as a "bounding box". According to the invention, a simple or complex bounding box may be virtually drawn, against which positional and other temporal information unique to the tracked object is compared to determine the current and subsequent locations of the tracked object relative to the bounding box, report and record the excursions, and updating current and historical positional information on a real-time or other user-defined basis.

A location monitoring system for uploading user requirements (defining the virtual boundary or bounding box) and downloading tracking and monitoring information is interfaced with the selected communications network through a world-wide-web site or private network. A radio-frequency transmitter is carried by the object to be tracked. Real-time feedback is provided alone or in combination by e-mail, through the world-wide-web in audio-visual format, and via independent audio stream and/or video display, and may be implemented in an electronic commerce environment.

DETAILED DESCRIPTION

Figure 1:
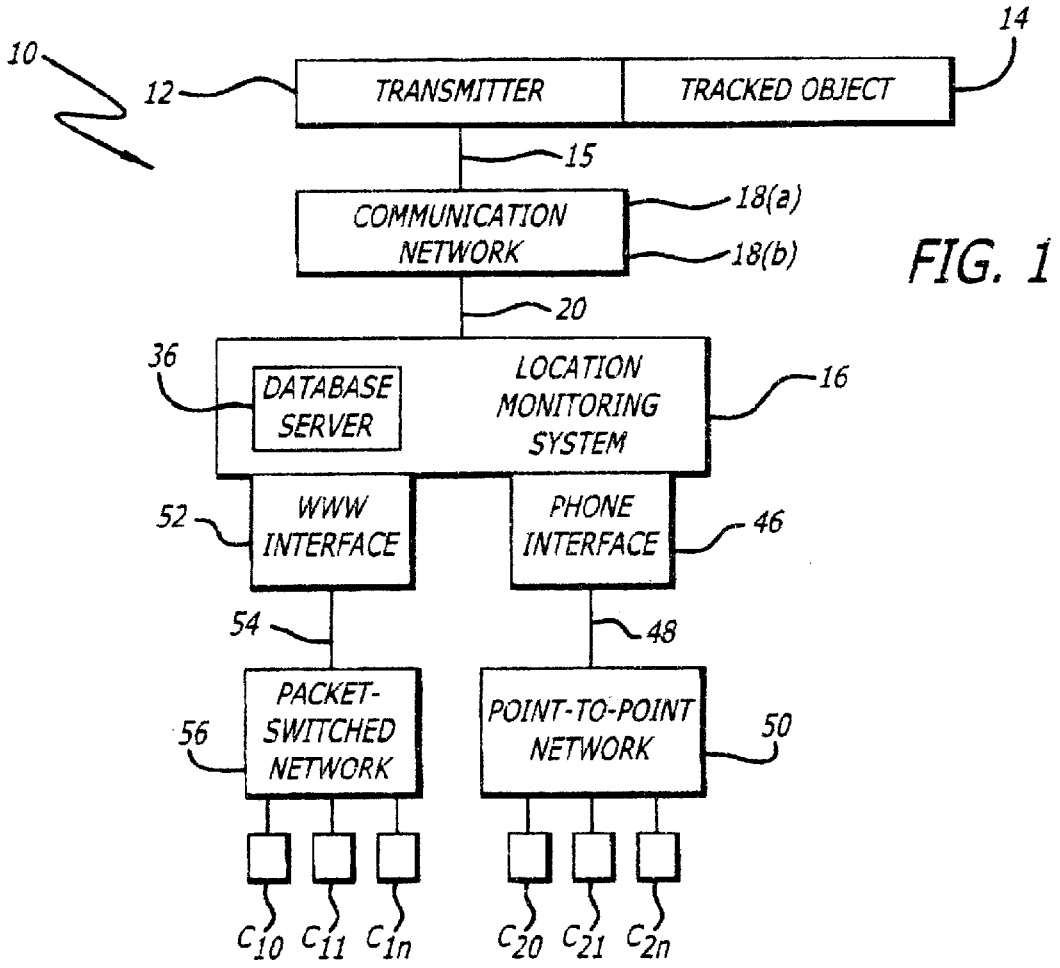
FIG. 1 is a block diagram representation of the monitoring and tracking system of the present invention.
Figure 2:
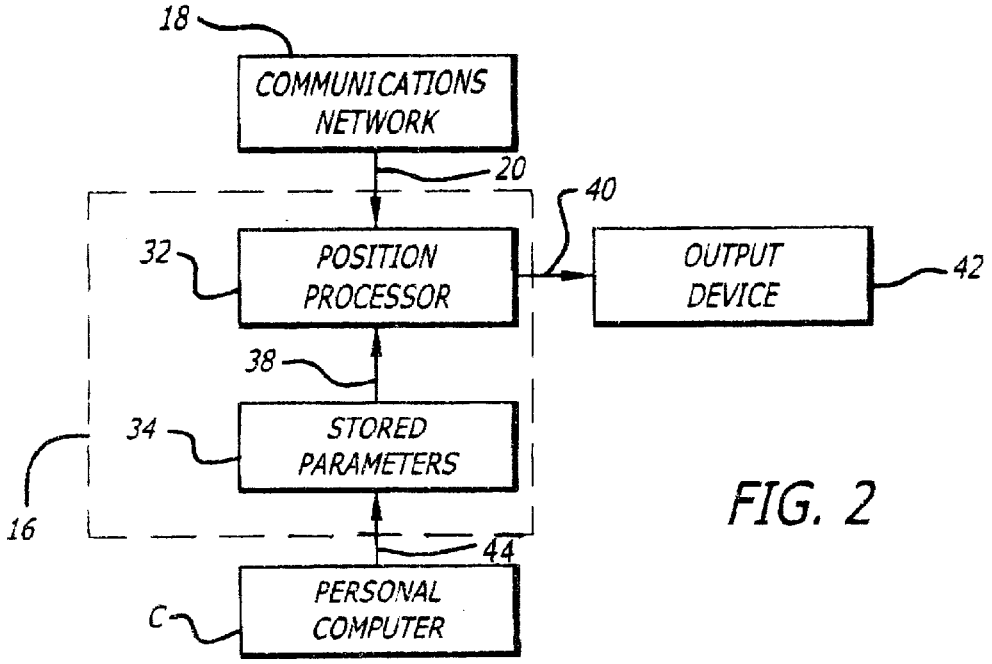
FIG. 2 is a schematic representation of the control system of the present invention.

With reference now to the drawings, according to one embodiment of the present invention, FIGS. 1 and 2 show a system 10 as it would be used in a field application for identifying, locating, and monitoring an object to be tracked within a user-defined area. System 10 includes a self-powered radio frequency transmitter 12 carried by an object 14 to be tracked and controlled by a microcontroller, for ultimately communicating identification, positional and other temporal information by wireless link 15 to a location monitoring system 16 remote from tracked object 14. It will be understood that transmitter 12 as hereinafter described may include a receiver in a transmitter/receiver combination to receive and transmit information relevant to the operation of system 10. Transmitter 12 may be temporarily or permanently installed, affixed, inserted, integrally formed with or otherwise prepared for secured transport by object 14 to be tracked. Tracked object 14 may be animate, such as a pet or human being, or inanimate such as an article carrier, fashion accessory, article of clothing, parcel, vehicle or commodity. Identification information is transmitted to location monitoring system 16 via a network of communications devices 18 transmitting and receiving information via wired or wireless link 20, and compares tracking information of tracked object 14 against a virtual boundary established via communications devices 18. Specifically, system 10 utilizes public and/or private communications networks to establish a dynamically reconfigurable "virtual" boundary against which the proximity and excursions of the tracked object is monitored, on a real-time or selected-interval basis, and provides notification via visual and/or auditory feedback if the tracked object crosses the virtual boundary or a defined opened or closed bounded area, hereinafter referred to as a "bounding box". Simple or complex boundaries defining the bounding box as defined by the user are established via the selected communications network.

The boundaries are updatable, either through a telephone point-to-point interface or via text or graphical mapping protocols supported by a world wide web browser, to establish a new or modified boundary or bounded area. Variables and inputs defining or altering the area encompassed by the bounding box area include day, time, weather, and characteristics of the object to be tracked. According to one embodiment of the invention, the tracked article 14 is configured to receive locational information from a network of global positioning satellites ("GPS"), or via triangulation utilizing a system of earth-bound radio beacons. According to this embodiment, a position determined by either type of positioning system may be transmitted periodically. That is, system 10 waits for individual inquiry and then transmits the position of tracked object 14. Alternatively, system 10 may transmit motion history of tracked object 14 at predetermined timed intervals.

According to the invention, communications devices 18 are configured to receive location information via transmitting elements of the cellular telephone infrastructure having individual cellular zones defined by a network of cellular towers used in the receipt, amplification when necessary, and retransmission of radio frequency signals commonly relayed through the cellular telephone infrastructure. Resolution of positional information will depend on the capabilities of individual cellular telephone systems through which tracking data are transmitted. Likewise, resolution of GPS-based positional information will depend on operating characteristics of the particular GPS system in use.

Transmitter 12 and communications devices 18 are compatible for wireless radio communication between location monitoring system 16 and communications devices 18. According to the invention, system 10 could include an interval timer which causes transmitter 12 to transmit on a fill-time, real-time basis, or at predetermined time intervals, or to respond to non-programmed inquiries. Alternatively, system 10 commands transmitter 12 to transmit upon interrogation from either a central site or an ancillary site, temporal information regarding the tracked object 14. Location monitoring system 16 receives a data signal including tracking, identification and other information transmitted by the communications network 18. System 10 may cause location monitoring system 16 to transmit a response to complete an electronic handshake to initiate a communications link. According to the invention, however, additional information must be reported and the advantages of a digitally formatted remote unit such as transmitter 12 will be apparent to those possessing an ordinary level of skill in the art.

Transmitter 12 is capable of transmitting at an energy conserving low-power level or at a high-power level under certain circumstances. For example, low-power transmission will be maintained when tracked object 14 is monitored to be within a preprogrammed bounding box, as will be further described below, and high-power transmission may be warranted during excursions of tracked object 14 beyond the predetermined borders of the bounding box.

Figure 3:
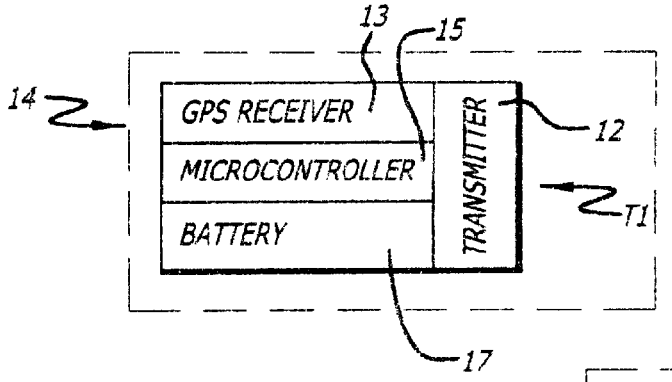
FIGS. 3–5 are schematic representations of various embodiments of a mobile transmitting unit carried by the tracked object for tracking and reporting its location and excursions.

With reference now generally to FIGS. 2–5, and with specific reference to FIG. 2, the bounding box is programmed as follows. Communications network 18 transmits the present location of tracked object 14 via radio frequency link 20 to a position processor 32, which compares the present location of tracked object 14 to bounding box parameters stored in memory 34 of a database server 36, responsive to position processor 32 via link 38. FIG. 3 shows a representative structure of a first embodiment of a transmitting apparatus T1 of the present invention incorporated in, attached to or carried by tracked object 14. Transmitting apparatus T1 includes transmitter 12 functionally engaged with a GPS receiver 13, and microcontroller 15 powered by a battery 17, to transmit and optionally receive signals through transmitter 12. According to this embodiment, apparatus T1 transmits its location to the central site at predetermined intervals.

Figure 4:
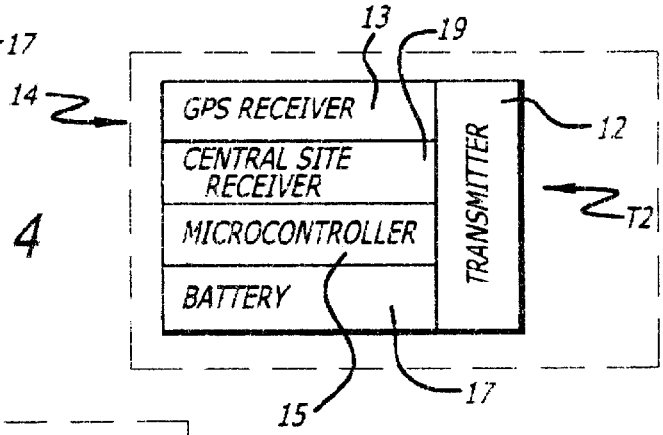
Figure 5:
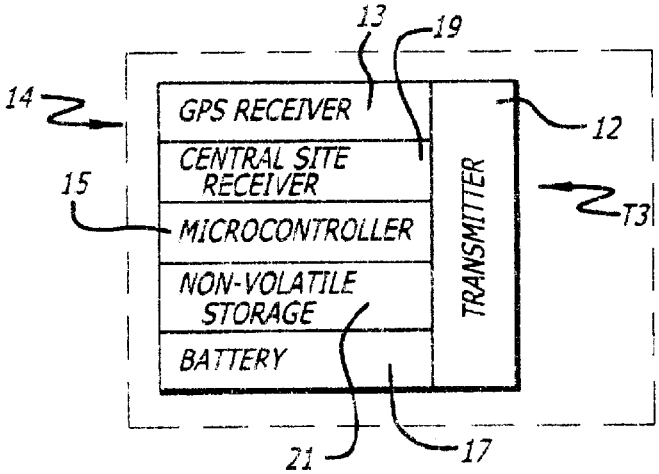

With reference to FIG. 4, transmitting apparatus T2 further adds a central site signal receiver 19 to transmitting apparatus T1 shown in FIG. 3. According to this embodiment, apparatus T2 transmits its location when the central site sends an inquiry, i.e., for on-demand location reporting (inquiry reporting) as will be more fully described below. Now with reference to FIG. 5, transmitting apparatus T3 further adds non-volatile memory 21 to transmitting apparatus T2 shown in FIG. 3. In this embodiment, apparatus T3 also transmits its location when interrogated by the central site. However, current and historical positional information may be recorded in on-board non-volatile memory, to be transferred or transmitted to the central site on demand or at preprogrammed intervals, either by RF transmission or by physical separation of the memory for downloading from a separate apparatus. Thus, transmitting apparatus T3 also functions as its own remote site for data collection.

According to the invention, if an excursion from the bounding box is detected, the appropriate signal is transmitted via link 40 to an output device such as a reporting and/or recording device 42, and this information is downloaded to either a central site for later data manipulation or retained in memory carried by the tracked object 14. According to the invention, bounding box parameters for simple or complex boundaries are inputted to database server 36, for comparison with the present, reported location of tracked object 14. Bounding box parameters are updatable, via text or graphical mapping protocols, to establish a new or modified boundary or bounded area. Thus, tracked object data includes location and excursion data, for present or future review and for computing an action to be taken based on the recorded trajectory and excursions of tracked object 14, and this information may be retained both locally within tracked object memory or remotely at a central or other remotely-linked site, as a plural number of receivers may be used with system 10.

System 10 thus provides a method of providing a service which utilizes a wireless communications network and a base station adapted to wirelessly communicate with one or more tracked objects. A user identification is assigned to each user having access to the communications network, the user identification being associated with each tracked object. Importantly, user defined time and/or boundary parameters are provided against which the object is tracked. More specifically, time and boundary parameters are selected from a schedule of time and/or boundary parameters. Each such time and boundary parameter is further selected from a schedule of conditional logical combinations of the time and boundary parameters. A contingency action based at least in part on time and/or location or other temporal information of the tracked object is then determined.

Figure 6:
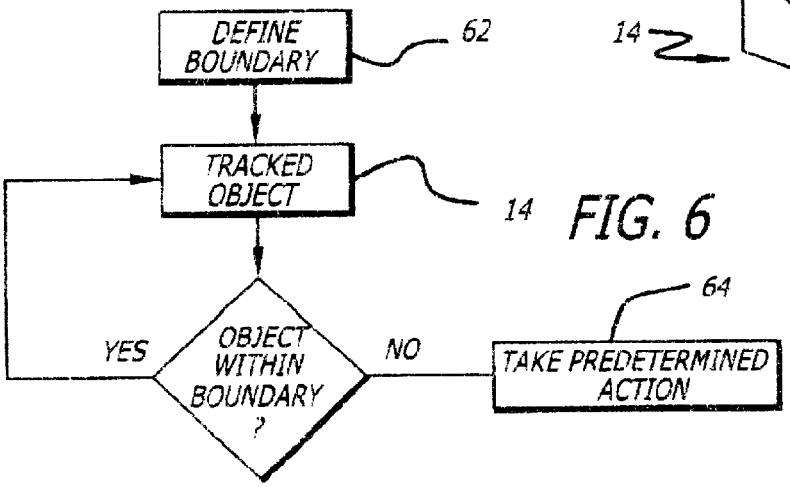
FIG. 6 is a block diagram representation of a positional inquiry.

With reference to FIG. 6, after the bounding box has been user-defined (step 62), the tracked object 14 is tracked relative to the boundary defining the bounding box, and in the instance where the tracked object traverses or otherwise breaches the bounding box constraints, a predetermined contingency action is implemented (step 64). One type of contingency action is the activation of a proximity alert communicated back to the user, the contingency action conditioned on a location of the tracked object. The proximity alert may be selected from a schedule of proximity alerts, each varying in degree of urgency or indication of relative distance or time, among other parameters.

According to one embodiment, a boundary or bounded area may be established having a relatively simple set of geographical borders. An approach or traverse of any of the so defined geographical borders may be considered discrete events that trigger an action. Such action may include activating an automatic telephone messaging service, triggering a pager, or otherwise reporting the event to the user.

According to another embodiment, the boundary or bounded area may be established by a plurality of circumscribed or overlaid regions against which a location of the tracked object is compared, and a selected proximity alert is activated based in part on the location of the tracked object relative to a set of boundary coordinates defined by the circumscribed regions. According to either example, increasing proximity to the borders may be mapped as a sequencing of the geographical location of the tracked object, and rate and time of approach determines a corresponding trigger action. A contingent action may then be programmed depending on proximity, time and rate of approach to a boundary or within one or more of the circumscribed regions or boundary zone combinations. Such triggering action may be defined as a major action or a minor action, based on a cumulative scaling protocol, and triggers the appropriate proximity alert. For example, increasing proximity by the tracked object to a monitored boundary within a predefined time period can result in triggering an alarm, ordering a prespecified action, enabling access to an otherwise secured region, or summoning assistance.

According to a further embodiment, progression of the tracked object through a sequential order of bounded zones may trigger an alert having a progressively increasing or decreasing urgency, based on a combination of factors including proximity to a boundary, relative speed toward/away from the boundary, predetermined time periods during which such actions are monitored, and whether permissions have been granted for ingress/egress within or proximate to a monitored boundary, as may be applicable to any mobile application operating within a preselected geographical envelope or restricted by at least one boundary.

The communications network over which bounding box data is transmitted may be a public or private packet-switched communications network. Furthermore, the tracking protocol is applicable to any wireless system, including but not limited to systems using code division multiple access technology ("CDMA") or time division multiple access technology ("TDMA") implemented in wireless systems operating in the United States and elsewhere. Location monitoring system 16 interfaces via a telephone (wired or wireless) interface 46 via link 48 to a point-to-point network 50, with boundary information inputted from customer computers C(20), C(21), . . . C(2n). Alternatively, system 16 interfaces via a world-wide-web interface 52 via link 54 to a packet switched network 56, with boundary information inputted from customer computers C(10), C(11), . . . C(1n). According to this embodiment, customers relay tracking and monitoring commands and data to/from transmitter 12 by modem connection to interface 52 which supports a world-wide-web browser through a dedicated web site, typically through a graphical user interface although non-graphical operating systems are adaptable to this system. Optionally, the web site is a world-wide-web portal. Furthermore, the system of the invention is continuously available to on-line and cellular telephone users. In either embodiment, networks 50, 56 communicate system commands including bounding box parameters between customer computers C and communication network 16 to upload and download tracking and monitoring parameters and data. Variables and inputs defining or altering the area encompassed by the bounding box area may include, but are not limited to, day, time, weather, and characteristics of the object to be tracked. Furthermore, multiple parameters may be set, such as geographical and durational parameters to monitor and track an object within a predetermined bounding box/region at specific times or time frames. Further parameters may include a dwell period and shifting regional sequencing, as would be contemplated for intelligent pattern setting.

In the illustrative embodiment, such data inputs may be communicated via a personal computer C interfaced via link 44 with memory 34. Likewise, tracking information is received from transmitter 12 carried by tracked object 14 and transmitted through the telecommunications infrastructure to the personal computer via the world-wide-web. Thus, on-line communication between the personal computer C and location monitoring system 16 are achieved via the world-wide-web, such that commands originating from a user's computer C are stored for comparison either at location monitoring system 16, a mirror site or other central processing sites in networked or stand-alone configuration or alternatively, in on-board memory of transmitter 12, although centralized data storage, as in database server 36 is preferred for weight and security considerations. It will be understood by those skilled in the art that system 10 will include a plurality of transmitters 12, each having a different identification number.

Thus, with centralized data storage, transmitter 12 memory and battery requirements are reduced, thereby providing for significant reductions in overall package size, weight and battery requirements. Furthermore, such minimization and miniaturization of overall transmitter package size enables packaging of transmitter 12 in various accessories and packages. For example, tracked object 14 may be provided in the form of jewelry such as necklaces and bracelets and the like incorporating the control circuitry and transmitter 12 of the present invention. Alternatively, transmitter 12 may be incorporated, integrally formed with, or adhered to any animate or inanimate object, whether for pet location (pet collars and kennels), fashion accessories including jewelry and the like, inventory control, sporting goods such as bicycles, luggage, or articles having a high intrinsic value. Alternatively, the tracked object 14 is integrated in clothing such as hats, caps, sneakers, jackets or other garments, or may be integrated in backpacks, fanny packs, wallets, purses, suitcases and the like. Furthermore, the tracked object 14 may be integrated into sporting equipment such as skis snowboards, roller skates and other equipment having free-ranging capabilities. In any case, the tracked object 14 is self-identifying for purposes of assignment to a system subscriber.

The invention is further applicable to proximity-sensing applications, whereby bounding boxes may be established around the tracked object 14, and encroachment or overlapping of the bounding boxes triggers detection circuitry and appropriate alarms as may be desired for collision avoidance, including but not limited to automotive and other vehicle applications. It is to be understood that geographically dimensional resolution of the system that could enhance the efficiency of such systems will be a function of the resolution of the cellular telephone system for that application, and civilian versus military resolution for the GPS application, and of further refinements to both systems and related communications networks to which this invention is applicable.

Additionally, on-line communication may be achieved through a controlled-access public or private internet or intranet, or through a world-wide-web portal or a service such as America Online. In any case, a subscriber or system user achieves connection to the communications network through the portal to attend to subscription/membership matters, and once subscribed to the system, inputting bounding box parameters and downloading tracking and related information. The system and method of the invention are configured for integration within an electronic-commerce environment. Accordingly, a fee structure is established for establishing and reconfiguring bounding boxes, for tracking and monitoring a selected object, subscription fees, transaction fees, monitoring fees, additional reconfiguration command fees, rebate credits, and access-time fees.

At least three tracking protocols may be followed. According to any of these protocols, the position of tracked object 14 is located relative to the bounding box defined by a virtual "fence" established between, for example, cellular telephone relay stations and cellular regions. Alternatively, a bounding box may be defined, and object 14 tracked relative to the so-defined bounding box via the existing network of GPS satellites encircling the Earth. For a GPS application, the location monitoring system 16 receives global positioning coordinates of transmitter 12 from a GPS receiver (not shown) for transmission to database server 36. The GPS system including a receiver and processing circuitry for determining the position of the tracked object 14 and provides that position in a world-wide coordinate system such as longitude and latitude through a coordinate converter (also not shown). This information is optionally converted into a preferred local coordinate system for display on a user's computer monitor for easy location of transmitting transmitter 12 and reconfiguration of the boundary box.

It is the virtual boundaries or "fences" established by either technique against which the position and movement of object 14 is to be monitored and tracked. As will be appreciated by the skilled artisan, relay stations and cellular regions of the cellular system infrastructure are correlated with geographical locations, and the appropriate relay stations and cellular regions are then identified and selected to define a boundary box. The system user inputs via an interface, and preferably a graphical-user interface as by delineating certain map regions, a simple or compound region against which object 14 is to be tracked. Various inputs may be provided to define the bounding box including map grid coordinates, geographical constraints, or topographical constraints. Further definition of an area to be bounded may be achieved to the degree of accuracy allowed by the communications network.

Figure 7:
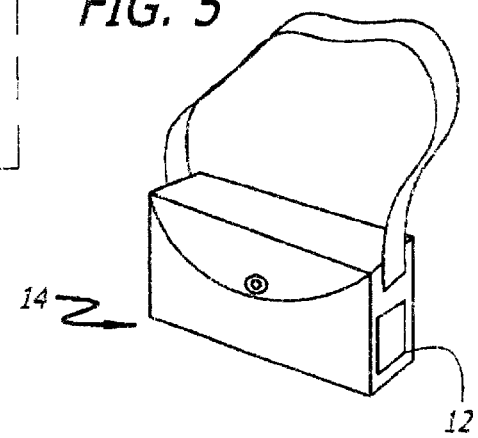
FIG. 7 is a drawing of one embodiment of an accessory.

Positioning and movement of tracked object 14 results in reporting of each position to position processor 32. However, the reporting interval may be defined as follows. First, object 14 incorporating transmitter 12 (FIG. 7) may be tracked by periodic location reporting at pre-selected time intervals or by inquiry reporting. This protocol requires less bandwidth, and less system time with lower operating expense. Second, object 14 may be tracked with responsive, on-demand location reporting (inquiry reporting), which possibly would require more hardware and/or software at greater expense, although with the important benefit of longer battery life of transmitter 12. Third, object 14 may be tracked on a real-time, full-time basis, with a commensurately larger power requirement. The appropriate fee may be assessed for a selected tracking protocol, e.g., an extra fee would be assessed for dynamic tracking due to the greater bandwidth requirement.

As the cellular telephone infrastructure provides extensive coverage over virtually all populated areas in most of the United States and is being rapidly deployed in most other countries as an essential element of the telecommunications web. In addition to the cellular technology widely available, ultrawide band radio communication has become readily available for low energy, wide spectrum applications. However, any suitable transmission system is contemplated for use with the invention, including but not limited to packet switching, analog and digital transmission systems. Thus, national and international cellular telecommunications networks provide the necessary backbone of the monitoring system of the present invention, and allows for operation of the system and method of the invention on a global basis.

It is to be understood that the present invention is not limited to the embodiments described above, but encompasses any and all embodiments within the scope of the following claims.

What is claimed is:

1. A method of providing a service, comprising:

providing a wireless communications network;

providing a base station;

assigning a user identification to each user having access to the communications network;

associating a tracked object with the user identification;

communicating a first set of information between the tracked object and the base station; and providing the user with access to a second set of information;

wherein the second set of information is related to the first set of information.

2. The method of claim 1, wherein the communications network is a public communications network.

3. The method of claim 1, wherein the communications network is a private communications network.

4. The method of claim 1, further comprising:

receiving a user inquiry at the base station and, in response to the user inquiry, enabling the user to select or receive data from the second set of information.

5. The method of claim 4, further comprising:

assessing a fee from the user based at least in part on the data selected by the user from the second set of information.

6. The method of claim 5, further comprising:

collecting a subscription fee from the user.

7. The method of claim 5, further comprising:

collecting a transaction fee from the user.

8. The method of claim 5, further comprising:

collecting a membership fee from the user.

9. The method of claim 1, further comprising:

providing a plurality of base stations networked with the communications network.

10. The method of claim 1, further comprising:

receiving boundary information from the user to create a virtual boundary.

11. The method of claim 1, wherein the first set of information comprises location information.

12. The method of claim 11, further comprising:

providing the location information at preprogrammed intervals to the base station.

13. The method of claim 11, further comprising:

providing the location information on a real-time basis to the base station.

14. The method of claim 11, further comprising:

inputting to the base station, data selected from the group consisting of topographical information, date and time information, and meteorological information.

15. The method of claim 1, further comprising:

providing a graphical user interface between the base station and the user.

16. The method of claim 15, wherein the graphical user interface comprises a world-wide-web graphical user interface at the base station.

17. The method of claim 1, wherein the tracked object is included within an accessory.

18. A method of providing a service for tracking an object relative to a boundary, the object having an identification, the method comprising:

establishing a virtual boundary that is reconfigurable;

comparing the location of the tracked object relative to the virtual boundary; and taking one or more predetermined actions based, at least in part, on a result of comparing the location of the tracked object to the virtual boundary;

further comprising determining the location of the tracked object.

19. A method of providing a service for tracking an object relative to a boundary, the object having an identification, the method comprising:

establishing a virtual boundary that is reconfigurable;

comparing the location of the tracked object relative to the virtual boundary; and taking one or more predetermined actions based, at least in part, on a result of comparing the location of the tracked object to the virtual boundary;

wherein the reconfigurable boundary defines a three-dimensional space.

20. The method of claim 19, further comprising:

receiving a user inquiry over a communication network and, in response to the user inquiry, enabling a user to select configuration and location data.

21. The method of claim 20, further comprising:

charging a fee to the user based, at least in part, on the service provided to the user.

22. The method of claim 21, further comprising collecting the fee.

23. The method of claim 21, further comprising:

collecting a subscription fee from the user.

24. The method of claim 21, further comprising:

collecting a transaction fee from the user.

25. The method of claim 21, further comprising:

collecting a membership fee from the user.

26. A method of providing a service for tracking an object having a location, relative to a boundary, the object having an identification, the method comprising:

(a) establishing a boundary that is subscriber-reconfigurable via a remote command system;

(b) comparing the location of the tracked object relative to the boundary and outputting a location tracking signal to the remote command system;

(c) receiving a subscriber inquiry from the remote command system and, in response to the subscriber inquiry, enabling the subscriber to update the boundary configuration; and (e) collecting a fee from the subscriber based at least in part on the data selected or received by the subscriber.

27. The method of claim 26, further comprising transmitting the fee for collection to a financial authorization network.

28. The method of claim 26, wherein the tracked object is included within an accessory.

29. A location monitoring system for tracking an object relative to a boundary, comprising:

a base station adapted to wirelessly communicate with one or more tracked objects, adapted to receive boundary coordinates and contingency action definitions from one or more users, adapted to compare a location of the tracked object to the boundary coordinates, and further adapted to take one or more contingency actions based, at least in part, on the location of the tracked object relative to the boundary coordinates;

wherein the location monitoring system is further adapted to bill one or more users for services rendered.

30. A method of providing a service for tracking an object relative to a boundary, the object having an identification, the method comprising:

establishing a virtual boundary that is reconfigurable;

comparing the location of the tracked object relative to the virtual boundary; and taking one or more predetermined actions based, at least in part, on a result of comparing the location of the tracked object to the virtual boundary;

wherein the tracked object is included within an accessory.

31. A method of providing a service, comprising:

providing a wireless communications network;

providing a base station adapted to wirelessly communicate with one or more tracked objects;

associating a tracked object with a user;

providing user defined time and/or boundary parameters against which the object is tracked; and selecting the time and boundary parameters from a schedule of conditional logical combinations of time and/or boundary parameters.

32. The method of claim 31, further comprising:

taking a contingency action based, at least in part, on time and/or location of the tracked object.

33. The method of claim 32, further comprising:

activating a proximity alert conditioned on a location of the tracked object.

34. The method of claim 33, further comprising:

establishing a plurality of circumscribed regions against which a location of the tracked object is compared, and activating a selected proximity alert based in part on the location of the tracked object relative to a set of boundary coordinates defined by the circumscribed regions.

35. The method of claim 33, further comprising:

selecting the proximity alert from a schedule of proximity alerts.

36. The method of claim 31 wherein the tracked object is an accessory selected from the group consisting of fashion accessories, clothing, bags, and sporting equipment.

37. The method of claim 31, wherein a wireless device associated with the user is integrated into an accessory.

38. The method of claim 31, wherein the tracked object is integrated into an accessory selected from the group consisting of fashion accessories, clothing, bags, and sporting equipment.

* * * * *